US007373701B2

(12) United States Patent
Coulombe et al.

(10) Patent No.: US 7,373,701 B2
(45) Date of Patent: May 20, 2008

(54) QUICK RELEASE BUCKLE

(75) Inventors: Robert G. Coulombe, Fort Erie (CA); Don F. Coulombe, Fenwick (CA)

(73) Assignee: Garrison Tool & Die Ltd., Fort Erie (CA)

( * ) Notice: Subject to any disclaimer, the term of this patent is extended or adjusted under 35 U.S.C. 154(b) by 39 days.

(21) Appl. No.: 10/711,289

(22) Filed: Sep. 8, 2004

(65) Prior Publication Data

US 2006/0048350 A1 Mar. 9, 2006

(51) Int. Cl.
*A44B 11/25* (2006.01)

(52) U.S. Cl. ..... 24/648; 24/647; 24/646; 24/650; 24/634; 24/638; 24/641; 24/265 BC; 24/265 EC; 24/171; 24/194

(58) Field of Classification Search ..... 24/648, 24/647, 646, 650, 171, 194, 196, 637, 638, 24/641
See application file for complete search history.

(56) References Cited

U.S. PATENT DOCUMENTS 1,209,369 A 12/1916 Wood
2,847,748 A 8/1958 Robinton
3,168,770 A * 2/1965 John, Jr. et al. ..... 24/648
3,201,840 A * 8/1965 Jantzen ..... 24/634
3,262,169 A * 7/1966 Jantzen ..... 24/323
3,775,813 A 12/1973 Higuchi
3,789,467 A 2/1974 Aratani et al.
4,091,508 A 5/1978 Yamada et al.
4,177,545 A 12/1979 Lambertz
4,202,243 A 5/1980 Leonhardt
4,321,734 A 3/1982 Gandelman
5,033,171 A 7/1991 Kasai
5,333,980 A 8/1994 Pratt et al.
5,584,105 A 12/1996 Krauss
5,649,341 A * 7/1997 Ashline et al. ..... 24/171
5,678,284 A 10/1997 Genero et al.
5,738,475 A 4/1998 Chaban
5,873,635 A 2/1999 Merrick
6,668,434 B2 * 12/2003 Casebolt et al. ..... 24/634
2002/0184742 A1 12/2002 Casebolt et al.

* cited by examiner

*Primary Examiner*—Robert J Sandy
*Assistant Examiner*—Marcus Menezes
(74) *Attorney, Agent, or Firm*—Simpson & Simpson, PLLC

(57) ABSTRACT

A quick release buckle assembly having a housing, two cams, a knurl bar, and two springs. Each spring is operatively arranged to engage both a respective cam and the knurl bar. The housing includes integral bearing walls for the cams.

12 Claims, 5 Drawing Sheets

Prior Art

QUICK RELEASE BUCKLE

FIELD OF THE INVENTION

The present invention relates generally to buckles, more specifically to a quick release buckle, and, even more particularly, to a quick release buckle used on a safety harness.

BACKGROUND

As is well known, quick release buckles have applications across a wide variety of fields. Examples include but are not limited to automobile/airplane seat belts, backpacks, parachute packs, and safety harnesses. Combining secure retention and quick-release capability is a common goal for these buckles.

Reliability is critical for quick release buckles. Three facets of reliability are: retaining the buckle connection; retaining the belt connection; and ease of release.

Buckle retention failures and belt retention failures are typically of greater concern than buckle release failures. For example, a buckle in a safety harness is designed to keep the harness secured to a user so as to keep the user safe in an otherwise hazardous situation. In this instance, failure of the buckle connection could result in harm to the harness user. Failure of the belt connection in a buckle also can have serious consequences.

FIG. 1 is a partial exploded perspective view of a prior art quick release buckle 1. One cause of failure in a quick-release buckle is malfunctioning of component parts in the buckle. Such malfunctioning can result from failure of the parts, for example, due to excessive wear, or to failure of otherwise functional parts to interface properly due to the complexity of the required interface. That is, increasing the complexity of a mechanism generally increases the probability of failure for the mechanism. Typically, moving parts and parts operating under stress in a device are more likely to suffer excessive wear. For example, in FIG. 1, cams 2 rotate about pins or rivets 3. The rotation causes wear on the cam surface and rivet surface that are in contact. In particular, wear on the rivet can cause the rivet to fail. Springs 4 and 5 are vital to the operation of buckle 1 in FIG. 1, since springs 4 hold the cams in the engaged position and springs 5 maintain the belt connection by pushing knurl bar 6 against a belt (not shown). Springs 4 and 5 both move and operate under stress, and therefore, may have an increased likelihood of failure. Regarding complexity, it is desirable to improve the reliability of a quick release buckle by simplifying the design of the buckle. That is, by decreasing the parts count in the buckle.

Increasing the parts count in a quick-release buckle also can increase the material cost for the buckle. Increasing the complexity and parts count in the buckle can increase the difficulty and cost of assembling the buckle as well, i.e., labor costs. Buckle 1 uses a "sandwich" assembly technique, a common method within the existing art. The "sandwich" is made up of three plates: center plate 7, containing the movable parts such as springs 4 and 5, and cams 2, sandwiched between two identical outer plates 8. During assembly, center plate 7 acts as a spacer providing proper clearance between cams 2 and outer plates 8, and knurl bar 6 and the outer plates 8. Additionally, the springs are positioned within center plate 7 via provided pockets. Lastly, center plate 7 provides a stop limiting the rotation of cams 2. Unfortunately, the outer plates may collapse if an excessive force is applied to the rivets, thereby preventing cam rotation. Failure of the cams to rotate would result in a non-functioning buckle. Another example of a prior art quick-release buckle using the previously mentioned "sandwich" assembly technique and thereby having an increased parts count and manufacturing complexity is disclosed in "HARNESS BUCKLE AND METHOD OF MAKING SAME" (United States Patent Application No. 2002/0184742).

Thus, there has been a long-felt need for a quick release buckle with reduced parts count and simplified design, and subsequent improvement in reliability and reduction of manufacturing and assembly costs.

BRIEF SUMMARY OF THE INVENTION

The present invention broadly includes a quick release buckle assembly having a housing, two cams, a knurl bar, and two springs. Each spring is operatively arranged to engage both a respective cam and the knurl bar. The housing also includes integral bearing walls for the cams.

A general object of the invention is to provide a quick release buckle having fewer component parts.

Another object of the invention is to improve the reliability of a quick release buckle.

A further object of the invention is to reduce the cost of manufacturing and assembling a quick release buckle.

Yet another object of the invention is to increase the strength of a quick release buckle housing.

These and other objects, features, and advantages of the present invention will become readily apparent to those having ordinary skill in the art upon reading the detailed description of the invention in view of the drawings and appended claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 2:
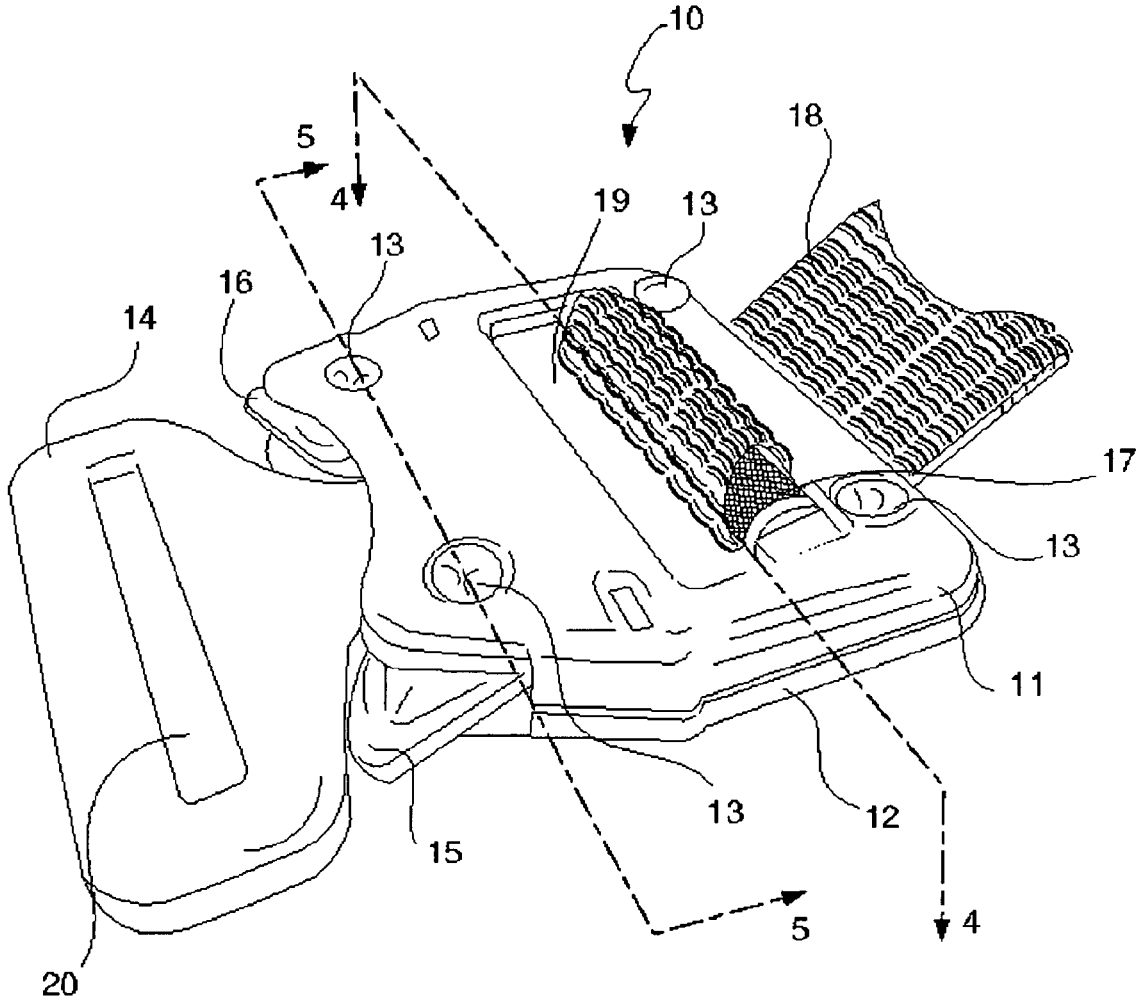
FIG. 2 is a perspective view of a present invention quick release buckle.

Adverting now to the figures, FIG. 2 is a perspective view of a present invention quick release buckle 10. Buckle 10 broadly includes upper housing 11 and lower housing 12 in which the remaining component pieces of buckle 10 are mounted and/or located. Upper housing 11 and lower housing 12 are held together by pins or rivets 13. However, it should be understood that other methods known in the art can be used to hold the housings together. Tongue plate 14 is retained within and released from buckle 10 by cams 15 and 16, as further described below. As further described below, a compressive force is applied to knurl bar 17 so that the knurl bar is pushed against and retains the portion of belt 18 disposed within buckle opening 19. A user can counteract the compressive force by pushing on bar 17 to enable adjustment of the belt. In addition to belt 18, a second belt (not shown) can be permanently secured through opening 20 of tongue plate 14.

Figure 3:
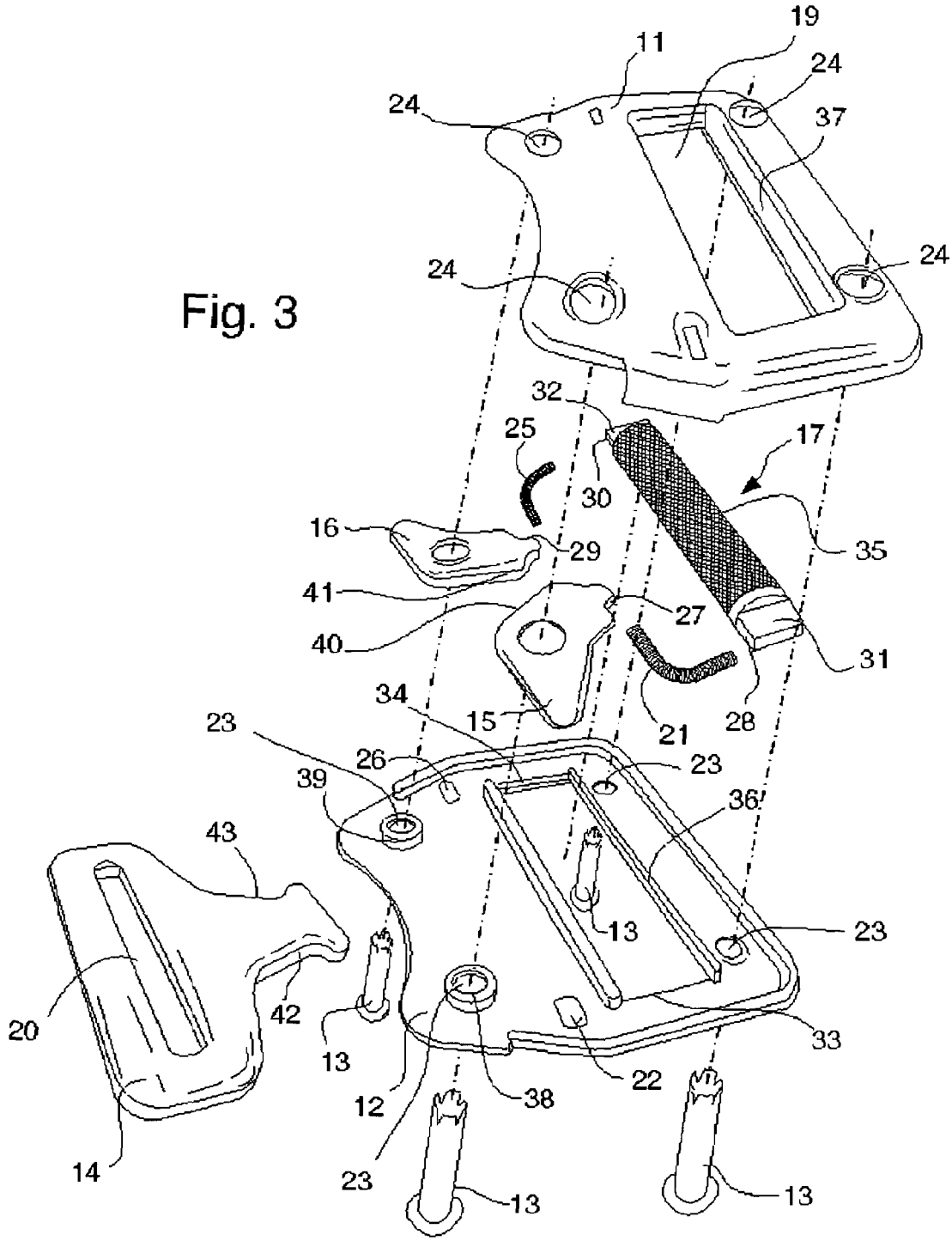
FIG. 3 is an exploded perspective view of the quick release buckle shown in FIG. 2.

FIG. 3 is an exploded perspective view of the quick release buckle shown in FIG. 2. Spring 21 is arranged within lower housing 12 and held in place by spring protrusion 22. In some aspects, a spring protrusion (not shown) in upper housing 11 also maintains the position of spring 21 within buckle 10. In like fashion, spring 25 is arranged within lower housing 12 and held in place by spring protrusion 26, and in some aspects a spring protrusion (not shown) in upper housing 11 also maintains the position of spring 25 within buckle 10. Pins 13 are inserted through holes 23 and 24 in the lower and upper housings, respectively.

Spring 21 imparts a compressive force against cam surface 27 and knurl bar surface 28. That is, spring 21 pushes against surfaces 27 and 28. In like fashion, spring 25 imparts a compressive force against cam surface 29 and knurl bar surface 30. The compressive forces described previous are essentially parallel to a plane formed by the page for FIG. 3. As further described below, the compressive force on the cam surfaces causes the cams to grip tongue plate 14. Knurl bar extensions 31 and 32 engage the upper and lower housings to permit knurl bar 17 to slide along housing slip surfaces, for example, surfaces 33 and 34 on lower housing 12. As the compressive force is applied to knurl bar 17, knurled surface 35 is pushed toward lower housing surface 36 and upper housing surface 37, thereby securing a belt (not shown) inserted within opening 19.

The following elements of buckle 10 are most easily seen in FIG. 3, however their functions are more fully described when viewed in combination with FIG. 4 below. Cams 15 and 16 are configured to mount to and rotate about mounting structures (hereafter referred to as bearing walls) 38 and 39, respectively. In FIG. 3, bearing walls 38 and 39 are extruded, however, it should be understood that other methods of forming the bearing walls integral to the housing are included within the spirit and scope of the claims. Latch surfaces 40 and 41 engage tongue surfaces 42 and 43, respectively.

Figure 1:
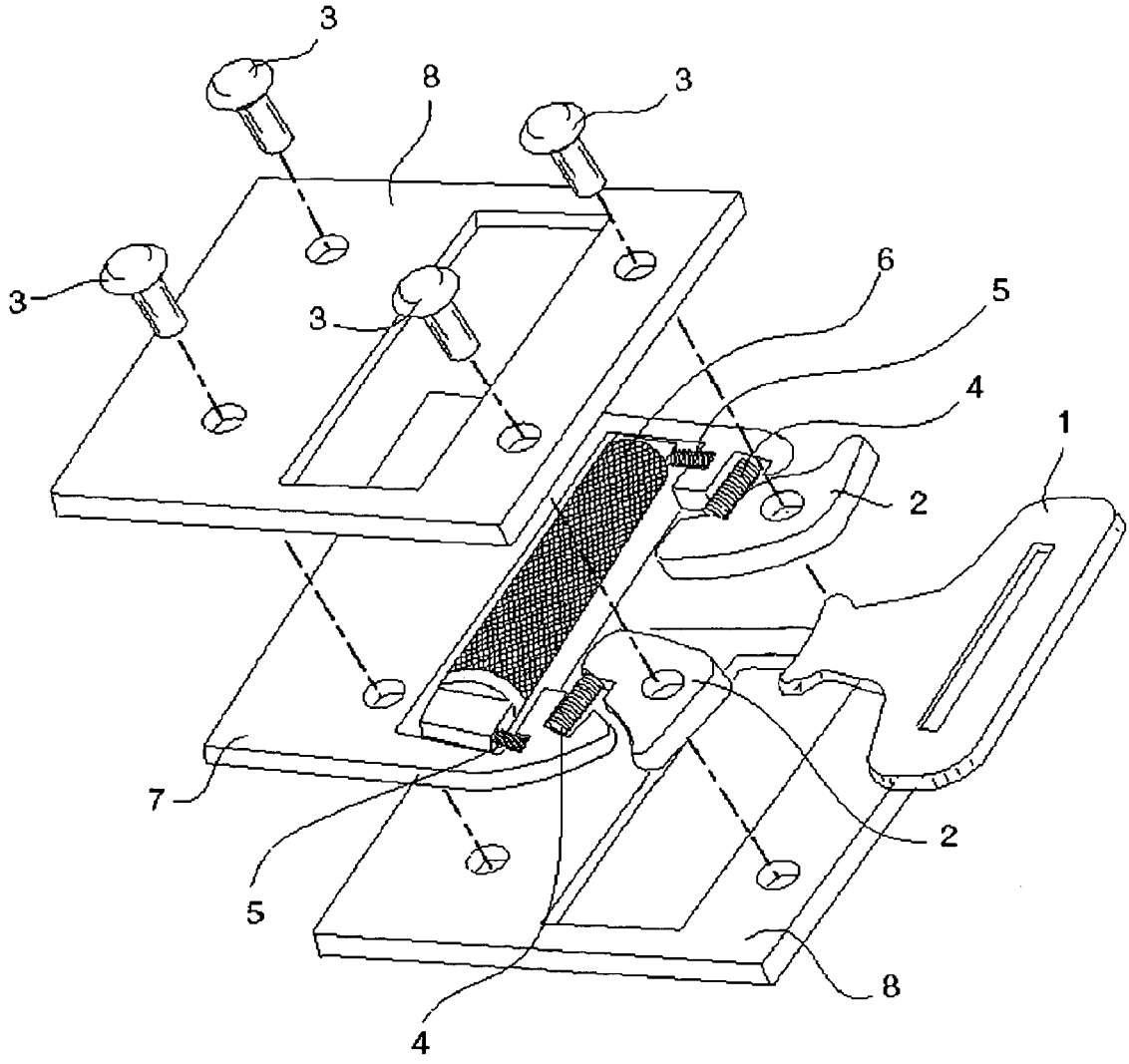
FIG. 1 is a partial exploded perspective view of a prior art quick release buckle.

The following should be viewed in light of FIGS. 1 and 2. As noted supra, for a quick release buckle, the reliability, ease of manufacture, and cost of manufacture are related to the complexity of the buckle. Further, the complexity typically increases with parts count. In general, buckle 10 uses fewer parts than prior art buckles, such as the buckle 1 or the buckle described supra. For example, buckle 10 eliminates the need for the center plate, since the outer wall forming, the bearing walls, and the spring protrusions perform the functions of the center plate described supra. Also, buckle 10 uses two springs instead of the four springs used by buckle 1 and has integral, extruded bearing walls instead of separate sleeves for mounting the cams. Thus, for buckle 10, the reduction in parts count increases reliability, simplifies the assembly process, and reduces manufacturing costs. In some aspects, certain components, for example, housings 11 and 12 and cams 15 and 16, are identical, further reducing manufacturing costs and reducing potential problems associated with incorrect part selection during assembly.

Figure 4:
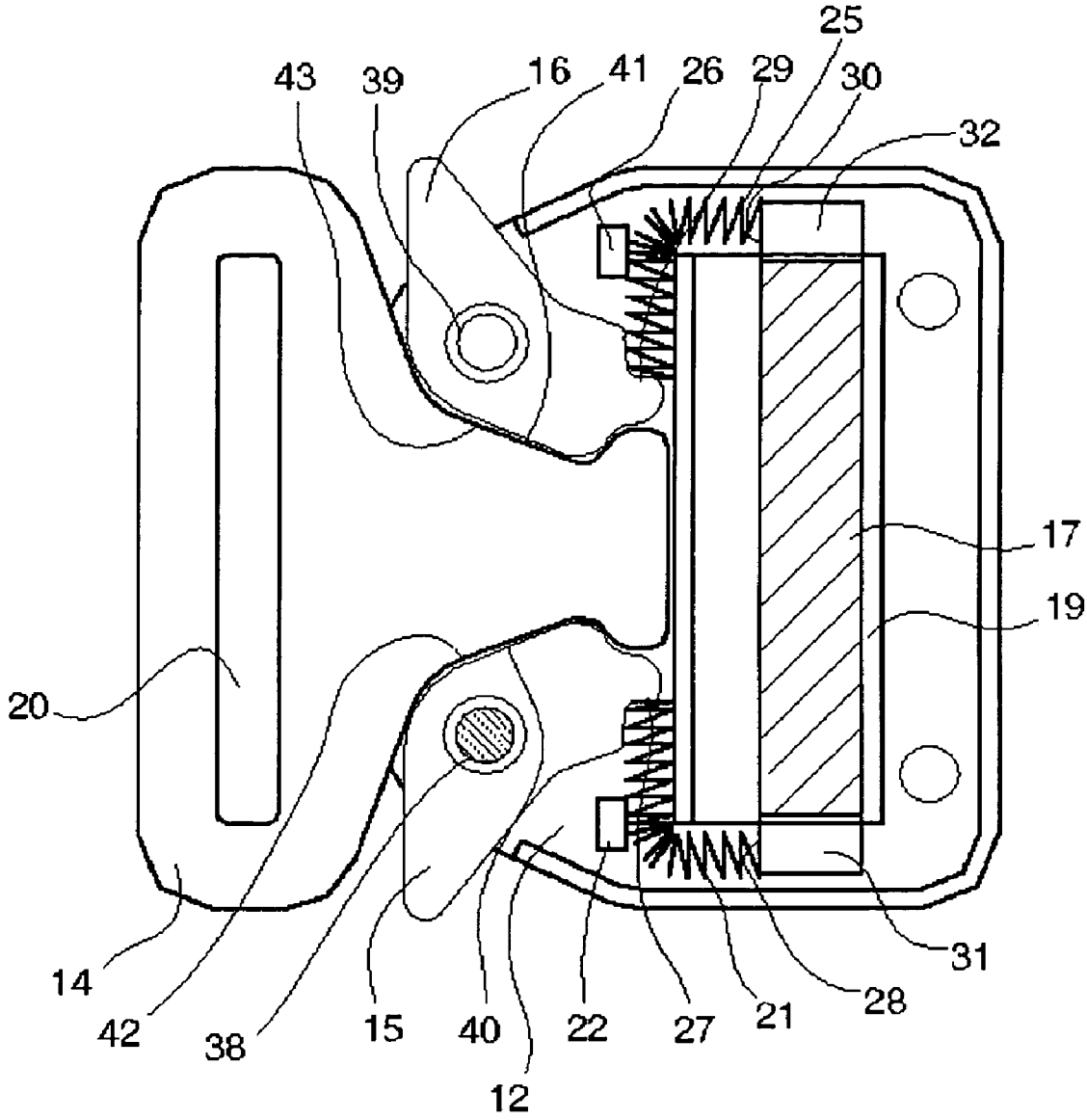
FIG. 4 is a cross-sectional view of the quick release buckle shown in FIG. 2, taken generally along line 4-4 of FIG. 2; and, FIG. 5 is a cross-sectional view of the quick release buckle shown in FIG. 2, taken generally along line 5-5 of FIG. 2.

FIG. 4 is a cross-sectional view of the quick release buckle shown in FIG. 2, taken generally along line 4-4 of FIG. 2. FIG. 4 shows lower housing 12. In some aspects, upper housing 11 includes features similar to those shown for lower housing 12, such as bearing walls. However, for the sake of brevity, such features are not described in further detail, as they are structurally and functionally similar to the features described for lower housing 12 infra. The ends of spring 21 are in contact with cam surface 27 and knurl bar surface 28, respectively and protrusion 22 holds the spring in the ninety-degree position shown in FIG. 4. In like fashion, the ends of spring 25 are in contact with cam surface 29 and knurl bar surface 30, respectively and protrusion 26 holds the spring in the ninety-degree position. Spring 21 applies compressive force to both cam surface 27 and knurl bar surface 28. Spring 25 applies compressive force to both cam surface 29 and knurl bar surface 30.

Tongue plate 14 is retained by cams 15 and 16. The operation of cam 15 is a mirror image of cam 16, therefore, for the sake of brevity, only the operation of cam 15 described. Directions are with respect to the orientation shown in FIG. 4. Cam 15 is arranged to mount to and rotate about bearing wall 38. The compressive force from spring 21 causes cam 15 to rotate in a counterclockwise direction, causing cam 15 to engage tongue plate 14. A user can push on cam 15, causing the cam to rotate in a clockwise direction, releasing tongue plate 14. The combined rotation of cams 15 and 16 against tongue plate 14 retains the tongue plate within quick release buckle 10.

In addition to applying compressive force to cams 15 and 16, springs 21 and 25 also apply a compressive force against knurl bar surfaces 28 and 30, respectively, biasing knurl bar 17 in a left-to-right direction in FIG. 4. Thus, knurled bar 17 is used to retain buckle 10 along a length of belt 18 (not shown). Hence, only two springs, 21 and 25, are used to provide biasing force to the cams and the knurl bar in buckle 10, as compared to the four springs used for the same purposes in the prior art buckle shown in FIG. 1.

Figure 5:
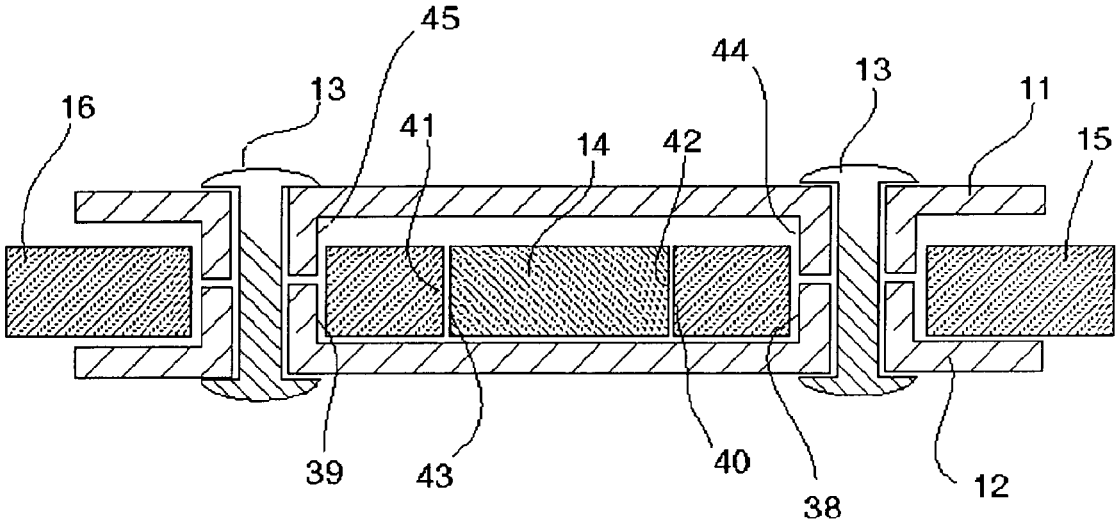

FIG. 5 is a cross-sectional view of the quick release buckle shown in FIG. 2, taken generally along line 5-5 of FIG. 2. The following should be viewed in light of FIGS. 3 and 5. As described above, upper housing 11 and lower housing 12 are assembled using rivets 13. Bearing walls 38 and 44 and bearing walls 39 and 45 respectively are aligned, thereby forming the openings through which rivets 13 are installed. The bearing walls also form the mounting structures upon which the respective cams rotate and provide adequate rotation clearance for cams 15 and 16 within housings 11 and 12. In addition, the structures fix the positions of the cams within the housing. In FIG. 5, the mounting structure for each cam is formed from two bearing walls of essentially equal length. For example, bearing walls 38 and 44 form the mounting structure for cam 15. However, it should be understood that the two bearing walls can have different lengths, for example, wall 38 could be longer than shown and wall 44 could be shorter than shown. It also should be understood that a mounting structure can be formed by a single bearing wall (not shown). For example, bearing wall 44 could be eliminated and bearing wall 38 could be lengthened to extend to upper housing 11.

The bearing walls add structural support to the housing by strengthening the area around holes 23 and 24. The bearing walls further improve the manufacturability of quick release buckle 10, i.e., process simplification, by enabling an increase in tolerances associated with fastening rivets 13. For example, during assembly, rivets 13 may be formed and/or tightened using increased force, without collapsing housings 11 and 12, thereby preventing the pinching of cams 15 and 16. Bearing walls 38, 39, 44, and 45 virtually eliminate wear on rivets 13 since cams 15 and 16 are in contact with the bearing walls rather than the rivets. Reducing wear on rivets 13 increases the reliability of buckle 10. To comply with safety agency requirements, a North American safety harness must have a tensile strength of at least 4000 lbs. The added structural strength provided by the bearing walls enables buckle 10 to meet these requirements with the use of smaller, less expensive rivets.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed:

1. A quick release buckle comprising:

a first cam;

a housing with an integral first mounting structure, wherein said first cam rotates about said first mounting structure;

a knurl bar;

a first spring engaged with said first cam and said knurl bar proximate a first end of said knurl bar;

a second cam pivotally mounted on an integral second mounting structure, said second cam rotates about said second mounting structure;

a second spring engaged with said second cam and said knurl bar proximate a second end of said knurl bar; and, a tongue blade, wherein said first and second cams grip said tongue blade in response to a compressive force.

2. The quick release buckle recited in claim 1 wherein said first spring is applies compressive force against said first cam and said knurl bar.

3. The quick release buckle recited in claim 2 further comprising:

a belt, wherein said knurl bar to grips said belt in response to said compressive force.

4. The quick release buckle recited in claim 1 wherein said housing further comprises first and second components and said mounting structure is integral to said first component.

5. The quick release buckle recited in claim 4 wherein said mounting structure is integral to said second component.

6. The quick release buckle recited in claim 1 wherein said mounting structure is extruded from said housing.

7. The quick release buckle recited in claim 1 wherein said housing further comprises first and second components and said mounting structure is operatively arranged to engage said first and second components.

8. A quick release buckle comprising:

a housing with a first mounting structure, wherein said first mounting structure is a protrusion fixedly attached to said housing;

a first cam pivotally mounted on said first mounting structure, said first cam rotates about said first mounting structure;

a knurl bar;

a first spring engaged with said first cam and said knurl bar, wherein said first spring applies compressive force against said first cam and said knurl bar;

a second mounting structure on said housing, wherein said second mounting structure is a protrusion fixedly attached to said housing;

a second cam pivotally mounted on said second mounting structure, said second cam rotates about said second mounting structure;

a second spring engaged said second cam and said knurl bar; and, a tongue blade, wherein said first and second cams grip said tongue blade in response to said engagement by said first and second springs, respectively.

9. The quick release buckle recited in claim 8 wherein said housing further comprises first and second components and said first mounting structure is integral to said first component.

10. The quick release buckle recited in claim 9 wherein said first mounting structure is integral to said second component.

11. The quick release buckle recited in claim 8 wherein said first mounting structure is extruded from said housing.

12. The quick release buckle recited in claim 8 wherein said housing further comprises first and second components and said first mounting structure is operatively arranged to engage said first and second components.

* * * * *